US010054395B1

(12) United States Patent
Fantozzi et al.

(10) Patent No.: US 10,054,395 B1
(45) Date of Patent: Aug. 21, 2018

(54) MULTI-SPECTRAL OPTICAL SYSTEM, MULTI-SPECTRAL WEAPON SIGHT AND WEAPON SIGHT SYSTEM

(71) Applicant: Knight Vision LLLP, Titusville, FL (US)

(72) Inventors: Louis Fantozzi, Windham, NH (US); Kenneth Greenslade, Mims, FL (US)

(73) Assignee: Knight Vision LLLP, Titusville, FL (US)

( * ) Notice: Subject to any disclaimer, the term of this patent is extended or adjusted under 35 U.S.C. 154(b) by 242 days.

(21) Appl. No.: 15/054,181

(22) Filed: Feb. 26, 2016

Related U.S. Application Data

(60) Provisional application No. 62/151,468, filed on Apr. 23, 2015.

(51) Int. Cl.

| | |
|---|---|
| ***G02B 17/00*** | (2006.01) |
| ***G02B 21/00*** | (2006.01) |
| ***G02B 23/00*** | (2006.01) |
| ***F41G 1/32*** | (2006.01) |

(52) U.S. Cl.
CPC ..... *F41G 1/32* (2013.01)

(58) Field of Classification Search
CPC ..... G02B 17/004; G02B 17/0605; G02B 17/0626; G02B 17/0647
See application file for complete search history.

(56) References Cited

U.S. PATENT DOCUMENTS 7,333,270 B1 * 2/2008 Pochapsky ..... F41G 1/32 250/330
2012/0162750 A1 * 6/2012 Vizgaitis ..... G02B 13/146 359/351

FOREIGN PATENT DOCUMENTS

EP 0 797 255 A2 * 9/1997 ..... H01L 27/146

OTHER PUBLICATIONS

EP 797255 A2 English Copy.*

* cited by examiner

*Primary Examiner* — Thomas K Pham
*Assistant Examiner* — Sharrief Broome
(74) *Attorney, Agent, or Firm* — Opticus IP Law PLLC

(57) ABSTRACT

A multi-spectral weapon sight optical system, a multi-spectral weapon sight, and a multi-spectral weapon sight system are disclosed. The multi-spectral weapon sight optical system includes first and second catadioptric optical systems arranged along a common axis and have a common aperture. The first catadioptric optical system forms a first on-axis image from first radiation having a first wavelength band while substantially transmitting second radiation to the second catadioptric optical system wherein the second radiation has a second wavelength band. The second catadioptric optical system forms a second on-axis image using the second radiation. First and second image sensors respectively receive the first and second images and form respective first and second digital images, which are then electronically fused to form a fused image. The fused image is displayed on a display and viewed as a visible display image using a day sight.

22 Claims, 11 Drawing Sheets

MULTI-SPECTRAL OPTICAL SYSTEM, MULTI-SPECTRAL WEAPON SIGHT AND WEAPON SIGHT SYSTEM

CROSS-REFERENCE TO RELATED APPLICATIONS

This Application claims the benefit of U.S. Provisional Patent Application No. 62/151,468, filed on Apr. 23, 2015, and which is incorporated by reference herein.

FIELD

The present disclosure relates to weapon sights, and in particular relates to an in-line multi-spectral optical system, a multi-spectral weapon sight that uses the multi-spectral optical system, and a weapon sight system that uses the multi-spectral weapon sight.

BACKGROUND

Many types of weapons (such as rifles) have weapon sights that allow the weapon's user to view a target within a scene and align the weapon relative to the target, e.g., to select a bullet impact point. A typical weapon sight includes a cross-hair reticle. The weapon sight is adjusted ("aligned") so that the cross-hairs match the desired bullet impact point for a given target distance. The typical weapon sight is configured to mount to a military standard rail mount ("rail") (e.g., MIL-STD 1913) that runs along the top and/or side of the weapon (forend and barrel).

A "night sight" weapon sight is used for night vision, while a "day sight" is used for day vision. Some weapon sights have combined night-vision and day-vision capability. Night sights can be configured to clip on and clip off of a weapon as needed.

In some cases, it is desirable to view a scene in a manner that combines images obtained at different wavelength bands. Such images are called "multi-spectral images" and require a weapon sight configured to handle the different wavelength bands. Unfortunately, conventional optical systems designed to handle multiple wavelength bands tend to be complex and bulky, while a weapon sight needs to be simple and compact.

SUMMARY

Aspects of the disclosure are directed to a multi-spectral optical system, to a multi-spectral weapon sight includes the multi-spectral optical system, and to a multi-spectral weapon sight system that uses the multi-spectral weapon sight.

An aspect of the disclosure is a multi-spectral weapon sight optical system, which includes: a first catadioptric optical system having a first optical axis and comprising a primary partially reflective concave mirror that substantially reflects first radiation having a first wavelength band and that substantially transmits second radiation having a second wavelength band different from the first wavelength band, the first catadioptric optical system forming a first image at a first image plane on the first optical axis using the first radiation; and a second catadioptric optical system having a second optical axis and arranged optically downstream from and in line with the first catadioptric optical system, with the second optical axis being coaxial with the first optical axis, the second catadioptric optical system comprising a primary reflective concave mirror that reflects the transmitted second radiation and that forms a second image at a second image plane on the optical axis using the second radiation.

Another aspect of the disclosure is the multi-spectral weapon sight optical system as described above, wherein the first catadioptric optical system and the second catadioptric optical system respectively include first and second focuses and respectively include first and second axially movable lenses configured to adjust the first and second focuses.

Another aspect of the disclosure is the multi-spectral weapon sight optical system as described above, wherein the first and second axially movable lenses are movable such that the first and second focuses are parfocal.

Another aspect of the disclosure is the multi-spectral weapon sight optical system as described above, wherein the first wavelength band includes short-infrared wavelengths and wherein the second wavelength band includes long infrared wavelengths.

Another aspect of the disclosure is the multi-spectral weapon sight optical system as described above, wherein the first wavelength band also includes visible wavelengths.

Another aspect of the disclosure is the multi-spectral weapon sight optical system as described above, wherein the first wavelength band is in the range from 900 nm to 1,700 nm and the second wavelength band is in the range from 8,000 nm to 12,000 nm.

Another aspect of the disclosure is the multi-spectral weapon sight optical system as described above, wherein the first wavelength band is in the range from 600 nm to 1,600 nm and the second wavelength band is in the range from 8,000 nm to 14,000 nm.

Another aspect of the disclosure is the multi-spectral weapon sight optical system as described above, wherein the first catadioptric optical system includes a first concave mirror having a dichroic optical that substantially reflects the first radiation and substantially transmits the second radiation.

Another aspect of the disclosure is the multi-spectral weapon sight optical system as described above, wherein the first concave mirror is made of germanium.

Another aspect of the disclosure is the multi-spectral weapon sight optical system as described above, wherein the first concave mirror is aspheric.

Another aspect of the disclosure is the multi-spectral weapon sight optical system as described above, wherein the system has substantially 1× magnification.

Another aspect of the disclosure is a multi-spectral weapon sight that includes: the multi-spectral weapon sight optical system as described above; a first image sensor arranged at the first image plane and configured to generate a first digital image; a second first image sensor arranged at the first image plane and configured to generate a second digital image; an electronics system configured to receive and process the first and second digital images to form a fused digital display image; and a display electrically connected to the electronics system and configured to receive the fused digital display image and form a visible display image.

Another aspect of the disclosure is a multi-spectral weapon sight system for use by a user and that includes: the multi-spectral weapon sight as described above; a display optical system operably arranged adjacent the display; and a day sight operably arranged adjacent the display optical system so that the user can view the visible display image via the display optical system.

Another aspect of the disclosure is a multi-spectral weapon sight optical system for forming first and second images from first and second radiation having different respective first and second wavelength bands and that includes: first and second catadioptric optical systems arranged in line along a common axis and that share a single aperture; wherein the first catadioptric optical system is configured to form a first image using the first radiation while transmitting the second radiation to the second catadioptric optical system; wherein the second catadioptric optical system is configured to receive the second radiation transmitted by the first catadioptric optical system and form a second image using the second radiation; and wherein the first and second images are each formed on the common axis.

Another aspect of the disclosure is the multi-spectral weapon sight optical system as described above, wherein the first and second catadioptric optical systems are each parfocal.

Another aspect of the disclosure is the multi-spectral weapon sight optical system as described above, wherein the first wavelength band includes short-infrared wavelengths and wherein the second wavelength band includes long infrared wavelengths.

Another aspect of the disclosure is the multi-spectral weapon sight optical system as described above, wherein the first wavelength band include visible wavelengths.

Another aspect of the disclosure is the multi-spectral weapon sight optical system as described above, wherein the first wavelength band is in the range from 900 nm to 1,700 nm and the second wavelength band is in the range from 8,000 nm to 12,000 nm.

Another aspect of the disclosure is the multi-spectral weapon sight optical system as described above, wherein the first catadioptric optical system includes a partially reflective concave mirror that includes a dichroic optical coating that substantially reflects the first radiation and substantially transmits the second radiation, and wherein the partially reflective concave mirror is defined by a refractive element that transmits the second wavelength and that serves as a corrector for the second catadioptric optical system.

Another aspect of the disclosure a multi-spectral weapon sight that includes: the multi-spectral weapon sight optical system as described above; a first image sensor arranged to receive the first image and that in response generates a first digital image; a second first image sensor arranged to receive the second image and that in response generates a first digital image; an electronics system configured to receive and process the first and second digital images to form a fused digital display image; and a display electrically connected to the electronics system and configured to receive the fused digital display image and form a visible display image.

Another aspect of the disclosure is the multi-spectral weapon sight optical system as described above, and further including a housing configured to be clipped on and off of a rail mount of a weapon.

Another aspect of the disclosure a multi-spectral weapon sight system for use by a user and that includes: the multi-spectral weapon sight as described above; a display optical system operably arranged adjacent the display; and a day sight operably arranged adjacent the display optical system so that the user can view the visible display image via the display optical system.

Additional features and advantages are set forth in the Detailed Description that follows, and in part will be readily apparent to those skilled in the art from the description or recognized by practicing the embodiments as described in the written description and claims hereof, as well as the appended drawings. It is to be understood that both the foregoing general description and the following Detailed Description are merely exemplary and are intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiments, and together with the Detailed Description serve to explain principles and operation of the various embodiments. As such, the disclosure will become more fully understood from the following Detailed Description, taken in conjunction with the accompanying Figures, in which.

DETAILED DESCRIPTION

Reference is now made in detail to various embodiments of the disclosure, examples of which are illustrated in the accompanying drawings. Whenever possible, the same or like reference numbers and symbols are used throughout the drawings to refer to the same or like parts. The drawings are not necessarily to scale, and one skilled in the art will recognize where the drawings have been simplified to illustrate the key aspects of the disclosure.

The claims as set forth below are incorporated into and constitute a part of this detailed description.

The entire disclosure of any publication or patent document mentioned herein is incorporated by reference, including U.S. Pat. No. 7,142,357, entitled "Night-Day boresight with adjustable wedge-prism assembly" (hereinafter, the '357 patent).

In the discussion below, a "user" (denoted U) refers to a person who uses the weapon sight system or one or more of its components, with example users including soldiers, paramilitary personnel, law-enforcement personnel (e.g., police, FBI, DEA, SWAT members) and civilians (e.g., sportsman, hunters, etc.).

Weapon and Weapon Sight System

Figure 1:
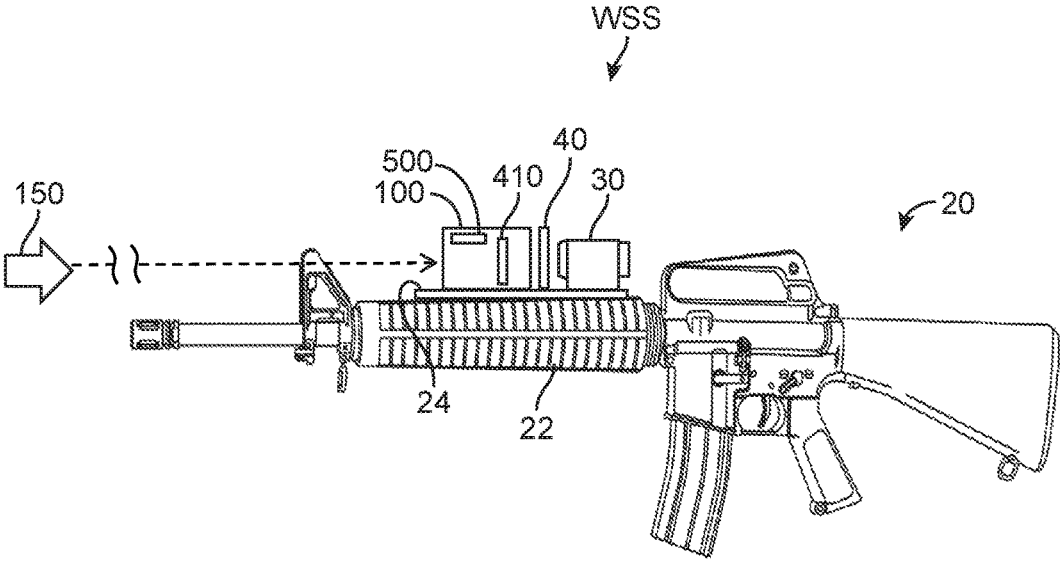
FIG. 1 is a diagram of an example weapon sight system that shows a side view of an example weapon that supports the multi-spectral weapon sight disclosed herein and that is shown operably arranged on the rail mount in front of a day sight.

FIG. 1 is a diagram of a weapon 20, which by way of example is shown as a rifle, and a weapon sight system WSS operably supported thereon. The weapon sight system WSS includes an in-line dual catadioptric single-aperture multi-spectral weapon sight (hereinafter, "multi-spectral weapon sight") 100 operably arranged in front of a day sight 30. The weapon 20 has a barrel 22 that supports a rail mount ("rail") 24, which in an example is a military-standard rail. The rail 24 operably supports a clip-on type of multi-spectral weapon sight 100 and a day sight 30. In an example, day sight 30 provides the optical magnification while multi-spectral weapon sight 100 has substantially unit magnification.

The multi-spectral weapon sight 100 is shown receiving light or radiation (hereinafter, "radiation") 150 from a scene. The radiation 150 is also referred to as "scene" 150. As discussed below, the multi-spectral weapon sight 100 has a display 410 configured to provide a visible display image that is viewable by a user through day sight 30. The weapon sight system WSS also includes support electronics 500, as described in greater detail below. In an example, weapon sight system WSS can include an adjustable wedge-prism assembly 40 (e.g., of the type disclosed in the'357 patent) operably arranged between multi-spectral weapon sight 100 and day sight 30.

Weapon Sight System with Multi-Spectral Weapon Sight

FIGS. 2A through 2D are schematic diagrams of weapon sight system WSS as disclosed herein, and show the main components of an example multi-spectral weapon sight 100. The light (radiation) 150 associated with scene being imaged includes radiation ("first radiation") 150-1 and radiation ("second radiation") 150-2 having respective first and second different (i.e., non-overlapping) wavelength bands $\Delta\lambda_1$ and $\Delta\lambda_2$. In an example, the first wavelength band $\Delta\lambda_1$ comprises or consists of visible and short-wavelength infrared (VIS-SWIR) radiation or just SWIR radiation, and the second wavelength band $\Delta\lambda_2$ comprises or consists of long-wavelength infrared (LWIR) radiation. In an example, VIS-SWIR radiation 150-1 is defined by the wavelength range between 500 nm to 1,700 nm or the range 600 nm to 1,600 nm while the LWIR radiation 150-2 is defined by the wavelength range between 8 microns to 14 microns (i.e., 8,000 nm to 14,000 nm). In another example, radiation 150-1 is SWIR radiation defined by the wavelength range between 900 nm to 1,700 nm and LWIR radiation 150-2 is defined by the wavelength range between 8 microns to 12 microns (i.e., 8,000 nm to 12,000 nm).

The multi-spectral weapon sight 100 has a housing 101 with an input end 102 that defines an aperture AP that receives radiation 150, an output end 104 and an interior 106. In an example, input end 102 is open, while in another example it is sealed with an optical window 110. In an example, housing 101 is configured so that multi-spectral weapon sight 100 can be clipped on to rail 24 of weapon 20 (see FIG. 1).

Figure 2A:
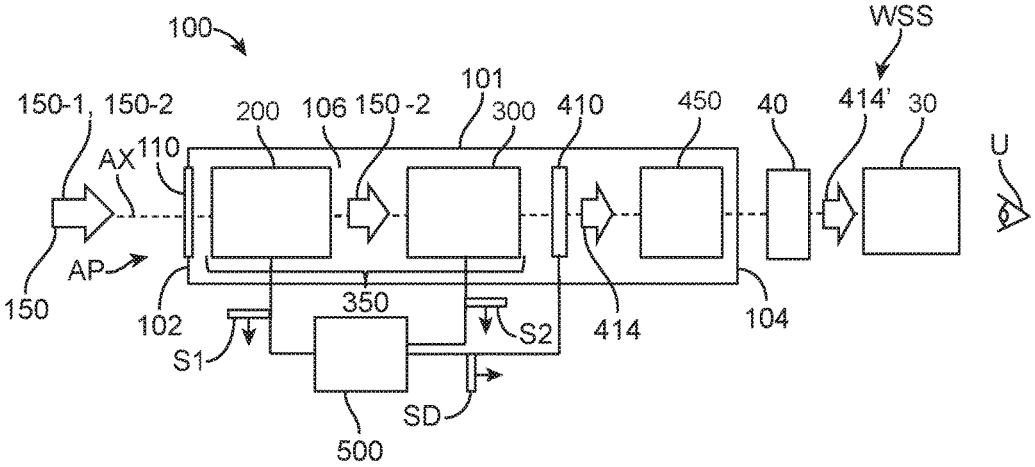
FIGS. 2A through 2D are schematic diagrams of example weapon sight systems that employ the multi-spectral weapon sights as disclosed herein.

With reference to FIG. 2A, multi-spectral weapon sight 100 includes, in order along an optical axis AX from the input end 102 to the output end 104: the optional optical window 110; a first catadioptric optical system 200 configured to process first radiation 150-1 and substantially transmit second radiation 150-2; a second catadioptric optical system 300 axially aligned with the first catadioptric optical system and configured to process second radiation 150-2; a display 410 that emits visible display light 412 that defines a (visible) display image 414; and a display optical system 450 operably arranged adjacent the display 410 and configured allow user U to view the display image 414 through day sight 30. In an example, the display optical system 450 presents a 1X (i.e., unity magnification) image to the day sight 30. In an example, display optical system 450 can be configured as an eyepiece that allows for direct viewing of the display image without the day sight. In an example, display optical system 450 can be designed as a modular unit that include display 410. In an example, display optical system 450 is designed for easy removal and insertion with respect to housing 101.

Figure 2B:
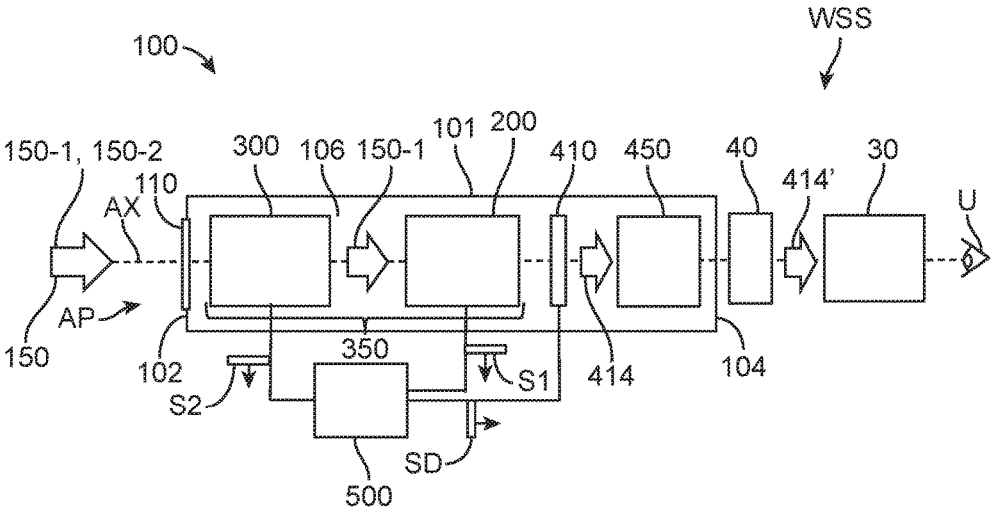

FIG. 2B is similar to FIG. 2A and illustrates an example configuration of multi-spectral weapon sight 100 where the order of the first catadioptric optical system 200 and the second catadioptric optical system 300 is reversed, and wherein the second catadioptric optical system is configured to transmit first radiation 150-1 so that it can be received and processed by the downstream first catadioptric optical system 200. It is noted however, that the physics of optical thin films is such that the configuration of multi-spectral weapon sight 100 of FIG. 2A wherein the shorter-wavelengths are reflected while the longer wavelengths are transmitted will be more efficient.

The example weapon sight systems WSS of FIGS. 2A and 2B show the optional adjustable wedge-prism assembly 40 being employed between display 410 and day sight 30. The adjustable wedge-prism assembly 40 can be used to present a boresighted display image 414 to day sight 30. This means that the position of display image 414 presented by display optical system 450 does not change the image position in day sight 30. The display image 414, after being adjusted by the adjustable wedge-prism assembly, is denoted 414' and is referred to hereinafter as the "adjusted display image" or "boresighted image."

The adjusted display image 414' (or just the display image 414 in the absence of the adjustable wedge-prism assembly 40) presents a visible-wavelength view of scene 150 to the user U based on the fusion of the first and second digital images respectively captured over the first and second wavelength bands $\Delta\lambda_1$ and $\Delta\lambda_2$ by the first and second catadioptric optical systems 200 and 300, as explained in greater detail below.

Figure 2C:
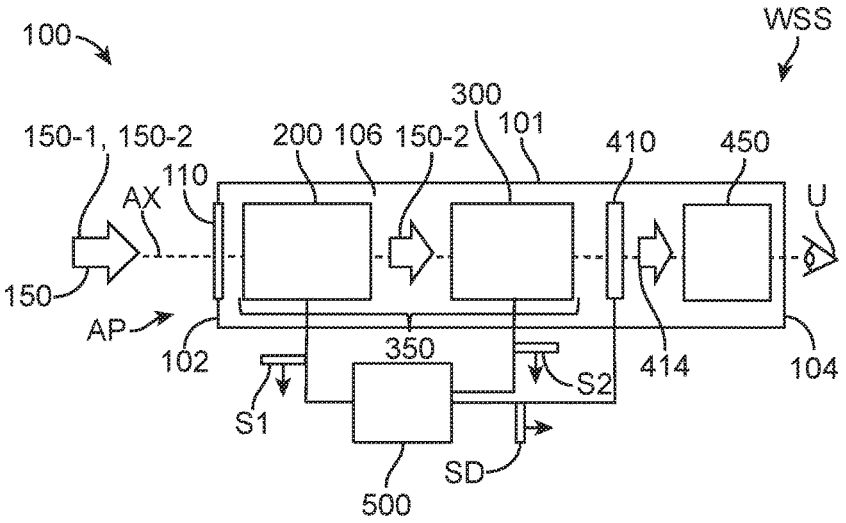
Figure 2D:
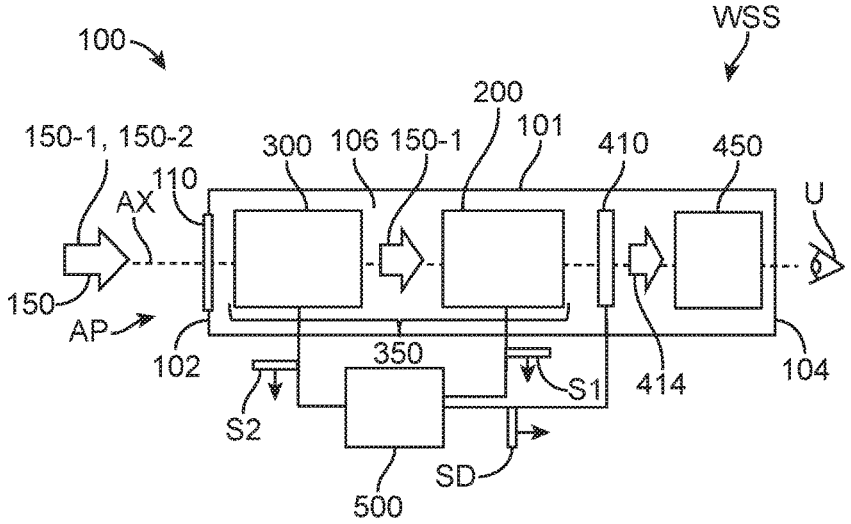

FIGS. 2C and 2D are similar to FIGS. 2A and 2B respectively, and illustrate an example where display optical system 450 is configured as an eyepiece that allows user U to view the display image 414 directly, i.e., without day sight 30.

Note that the in-line configuration of catadioptric optical systems 200 and 300 allows for the single aperture AP at input end 102 of housing 100.

With continuing reference to FIGS. 2A through 2D, the multi-spectral weapon sight 100 includes an electronics system 500 operably configured with respect to the first and second catadioptric optical systems 200 and 300 and to display 410.

In the general operation of multi-spectral weapon sight 100, first and second catadioptric optical systems respectively receive and process first and second radiation 150-1 and 150-2 to form respective first and second digital images embodied in first and second digital-image signals S1 and S2, respectively. The first and second digital image signals S1 and S2 are sent to electronics system 500, which is configured to process the first and second digital images to form a fused visible-wavelength display image embodied in a display-image signal SD. The display-image signal SD is provided to display 410, which displays the fused visible-wavelength display image 414. The fused visible-wavelength display image 414 is then processed by display optical system 450 so that it can be viewed by the user either via day optics 30 or directly, depending on the configuration of the display optical system.

The first and second catadioptric optical systems 200 and 300 define an example multi-spectral weapon sight optical system 350, and in an example the multi-spectral weapon sight 100 can be thought of as including at least the multi-spectral optical system 350 and the electronics system 500.

Example Catadioptric-Based Multi-Spectral Weapon Sights

FIGS. 3A through 3D are more detailed views of an example embodiment of weapon sight system WSS and the multi-spectral weapon sight 100 used therein. FIGS. 3A through 3D also show more details of the example multi-spectral weapon sight optical systems 350 disclosed herein. The configurations of the example multi-spectral weapon sights 100 of FIGS. 3A through 3D correspond to the clip-on based embodiment wherein the multi-spectral weapon sight is used in combination with day sight 30.

As discussed below, the general configuration of the example multi-spectral weapon sights 100 disclosed utilizes two in-line catadioptric optical systems 200 and 300 that have a single aperture AP, with the two catadioptric optical systems configured to form respective first and second images for different (i.e., non-overlapping) wavelength bands $\Delta\lambda_1$ and $\Delta\lambda_2$.

The multi-spectral weapon sight 100 includes the aforementioned optional planar window 110 arranged at input end 102 of housing 101 and that is configured to transmit first and second radiation 150-1 and 150-2 through single aperture AP. One useful purpose of window 110 is to seal the housing interior 106 from the outside environment while also providing an accessible surface for collecting dirt, debris etc. and that can be readily cleaned in the field. In an example, a lens cover (not shown) that fits over input end 102 can be used to keep window 110 clean while multi-spectral weapon sight 100 is not in use. An example material for window 110 is ZnSe. In an example, window 110 is tilted at an angle (e.g., greater than 2 degrees) to prevent unwanted reflections from being detected (i.e., imaged onto the first and/or second image sensors).

Figure 3A:
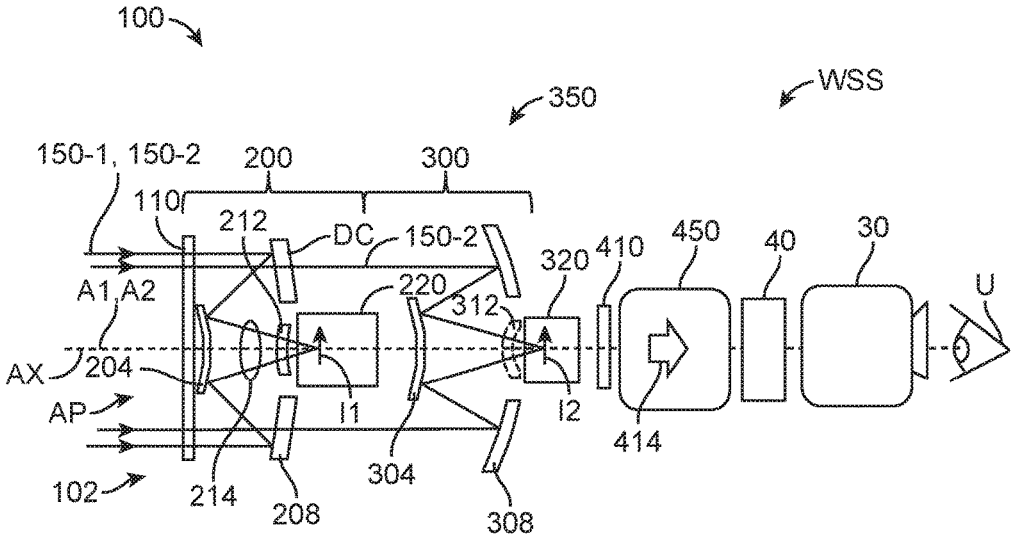
FIGS. 3A through 3D are similar to FIGS. 2A and 2D and show more details of the multi-spectral weapon sight optical systems used in the multi-spectral weapon sights.
Figure 3B:
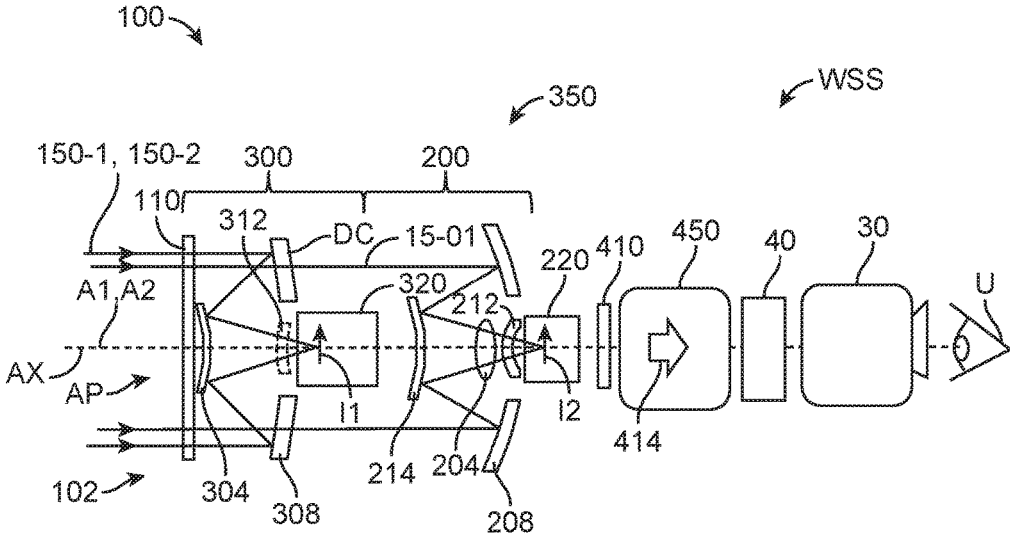
Figure 3C:
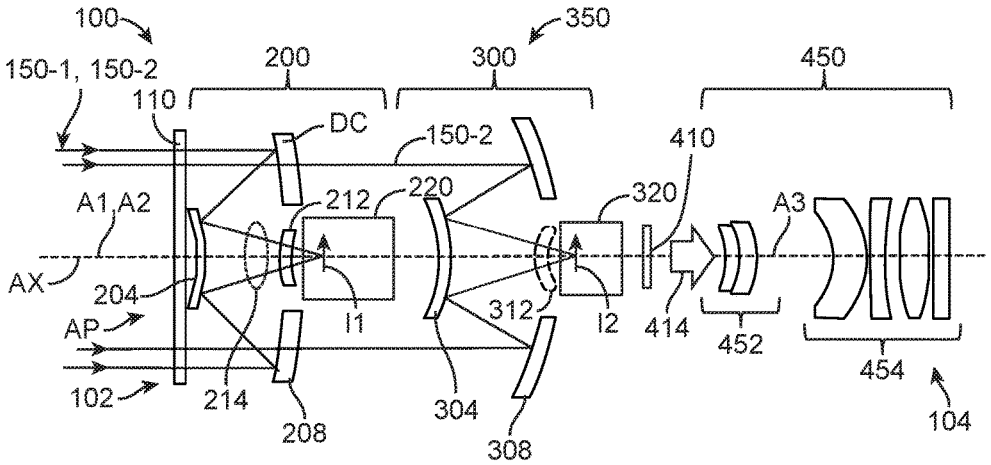

With reference to FIGS. 3A and 3C, the first catadioptric optical system 200 includes, order along a first optical axis A1 that resides along the system axis AX: a secondary convex mirror 204, a primary partially reflecting concave mirror 208, and a meniscus refractive element 212. One or more refractive elements 214 may also be arranged along axis AX between secondary convex mirror 204 and meniscus refractive element 212. In an example, refractive elements 212 and 214 define an achromatic field corrector, such as described below in connection with the example embodiment of FIG. 4. In an example, refractive element 212 is made of ZnSe, while refractive element 214 is made of calcium fluoride ($CaF_2$).

The primary partially reflecting concave mirror 208 is configured to substantially reflect first radiation 150-1 of wavelength band $\Delta\lambda_1$ while substantially transmitting second radiation 150-2 of wavelength band $\Delta\lambda_2$. This is accomplished for example through the use of a dichroic optical coating DC formed on a material that generally transmits second radiation 150-2 of wavelength band $\Delta\lambda_2$. In an example, the curvature of primary partially reflecting mirror 208 is aspheric.

The first catadioptric optical system 200 is configured to form a first image 11 using first radiation 150-1 at a first image sensor 220 that resides on second optical axis A2 (and thus on system axis AX) within the central obscuration or "shadow" formed by secondary convex mirror 204. In an example, the dichroic optical coating DC is formed such that about 98% or greater of the first radiation 150-1 is reflected while about 98% or greater of the second radiation 150-2 is transmitted.

Likewise, second catadioptric optical system 300 includes, in order along a second optical axis A2 that resides along the system axis AX (so that axes A1 and A2 are coaxial): a secondary convex mirror 304, a primary concave mirror 308 and an optional meniscus refractive element 312. The primary concave mirror 308 is configured to reflect substantially all of second radiation 150-2 of wavelength band $\Delta\lambda_2$ that passes through partially reflecting concave mirror 208.

The second catadioptric optical system 300 is configured to form a second image 12 using second radiation 150-2 at a second image sensor 320 that resides on second optical axis A2 (and thus on system axis AX). Because primary partially reflecting mirror 208 transmits second radiation 150-2, it is part of second catadioptric optical system 300, acting as acts as a refractive lens element. Thus, the design of second catadioptric optical system 300 includes primary partially reflecting mirror 208 as a first refractive element in the system and this elements serves as a corrector element. Consequently the curvature of reflecting surface of the primary partially reflective mirror 208 on which dichroic optical coating DC is formed needs to be taken into account in the design of both the first and second catadioptric optical systems 200 and 300.

In an example, primary partially reflecting mirror 208 is made of germanium. In an example, the dichroic optical coating DC formed on primary partially reflecting mirror 208 is configured to have high reflection in the SWIR wavelength range of 0.9 microns to 1.7 microns while also having a high transmission in the LWIR wavelength range of 8 microns to 12 microns. In an example, second image sensor 320 includes a vanadium-oxide (Vox) long-wavelength detector array (e.g. a Vox camera).

Figure 3D:
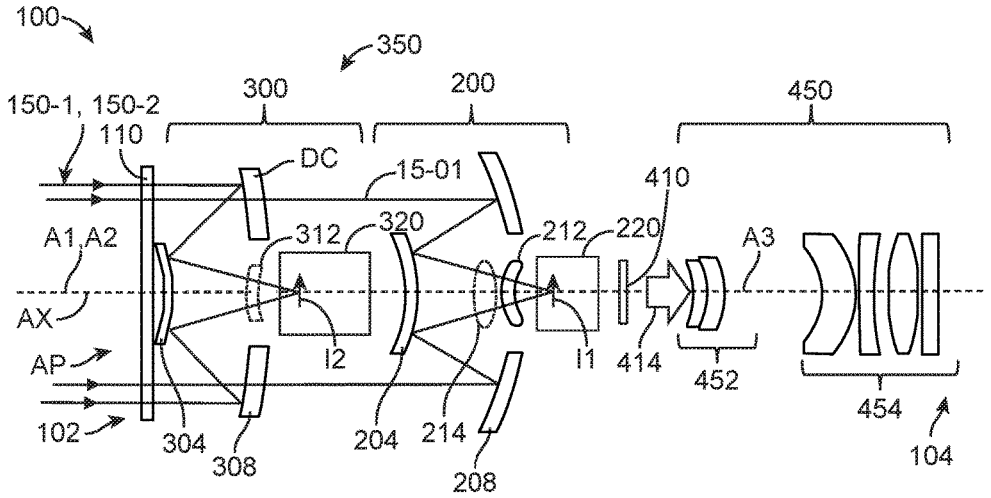

With reference to FIGS. 3B and 3D, the second catadioptric optical system 300 is arranged in front of the first catadioptric optical system 200. In this configuration, the aforementioned primary full-reflective mirror 308 is now partially reflective by virtue of a dichroic optical coating DC configured to transmit first radiation 150-1 while the aforementioned primary partially reflective mirror 208 is now a fully reflective mirror. Note that the primary partially reflective mirror 308 in this embodiment is made of a material that substantially transmits SWIR or VIS-SWIR wavelengths.

In the various configurations of multi-spectral weapon sight 100, the first and second image sensors 220 and 230 reside on axis and within the zone of obscuration defined by the secondary convex mirror 204 (e.g., the configuration of FIG. 3A) or the secondary convex mirror 304 (the configuration of FIG. 3B). This allows for multi-spectral weapon sight 100 to make efficient use of the space within housing 101 and to be axially and laterally compact.

Thus, with reference to the embodiments of FIGS. 3A and 3C, in one example the first radiation 150-1 has a VIS-SWIR or SWIR first wavelength bandwidth $\Delta\lambda_1$ while the second radiation has the LWIR second bandwidth $\Delta\lambda_2$, with the primary partially reflective mirror 208 having a dichroic coating that substantially reflects the VIS-SWIR or SWIR wavelengths and substantially transmits the LWIR wavelengths. Likewise, in the embodiments of FIGS. 3B and 3D, the primary partially reflective mirror 308 has a dichroic optical coating DC that substantially reflects the LWIR wavelengths and substantially transmits the VIS-SWIR or SWIR wavelengths.

In an example, the first and second catadioptric optical system 200 and 300 are configured to have the same magnification, e.g., substantially 1×.

The display 410 resides along the system axis AX adjacent the most rearward image sensor, which in FIGS. 3A and 3C is the second image sensor 320 while in FIGS. 3B and 3D is the first image sensor 220. In the examples shown in FIGS. 3A and 3B, the display optical system 450 is configured to allow user U to view the display image 414 via day sight 30 and also shows the optional wedge-prism assembly 40 arranged adjacent the input end of the day sight. FIGS. 3C and 3D show an example display optical systems 450 that includes an optical axis A3 and two lens groups 452 and 454 (the day sight 30 is not shown in FIGS. 3C and 3D for ease of illustration). In an example, optical axis A3 is coaxial with system axis AX.

In an example of multi-spectral weapon sight 100, the various optical elements and support components (such as lens mounts, spiders, etc. not shown) are selected in a manner that makes multi-spectral weapon sight substantially athermalized.

Also in an example, the secondary convex mirror 204 or 304, when residing immediately adjacent window 110, can be bonded thereto.

The multi-spectral weapon sight 100 can be used to provide a boresighted image (i.e., an aim point or bullet-impact-point position corrected by adjustable wedge-prism assembly 40) to day sight 30 when the day sight is used to view the display image 414 (or more particularly, the adjusted display image 414').

Another Example Multi-Spectral Weapon Sight Optical System

Figure 4:
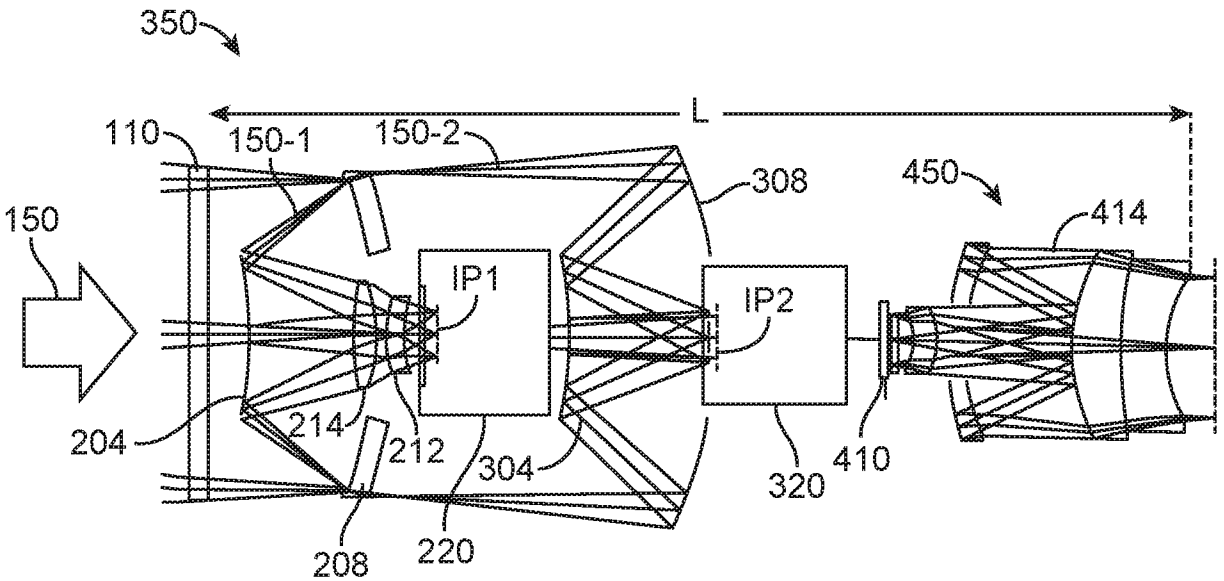
FIG. 4 is a schematic diagram of an example multi-spectral weapon sight optical system.

FIG. 4 is a schematic diagram of another example multi-spectral weapon sight optical system 350 according to the disclosure. The example multi-spectral weapon sight optical system 350 includes a Bouwers type display optical system 450 for viewing the display image through day sight 30. The example display optical system 450 has a field of view of +/−3.9 degrees. The overall length L of the multi-spectral weapon sight optical system 350 and the display optical system 450 is about 206 mm. The size of aperture AP is about 67 mm and the diameter of the obscuration is about half of the aperture size.

Figure 5A:
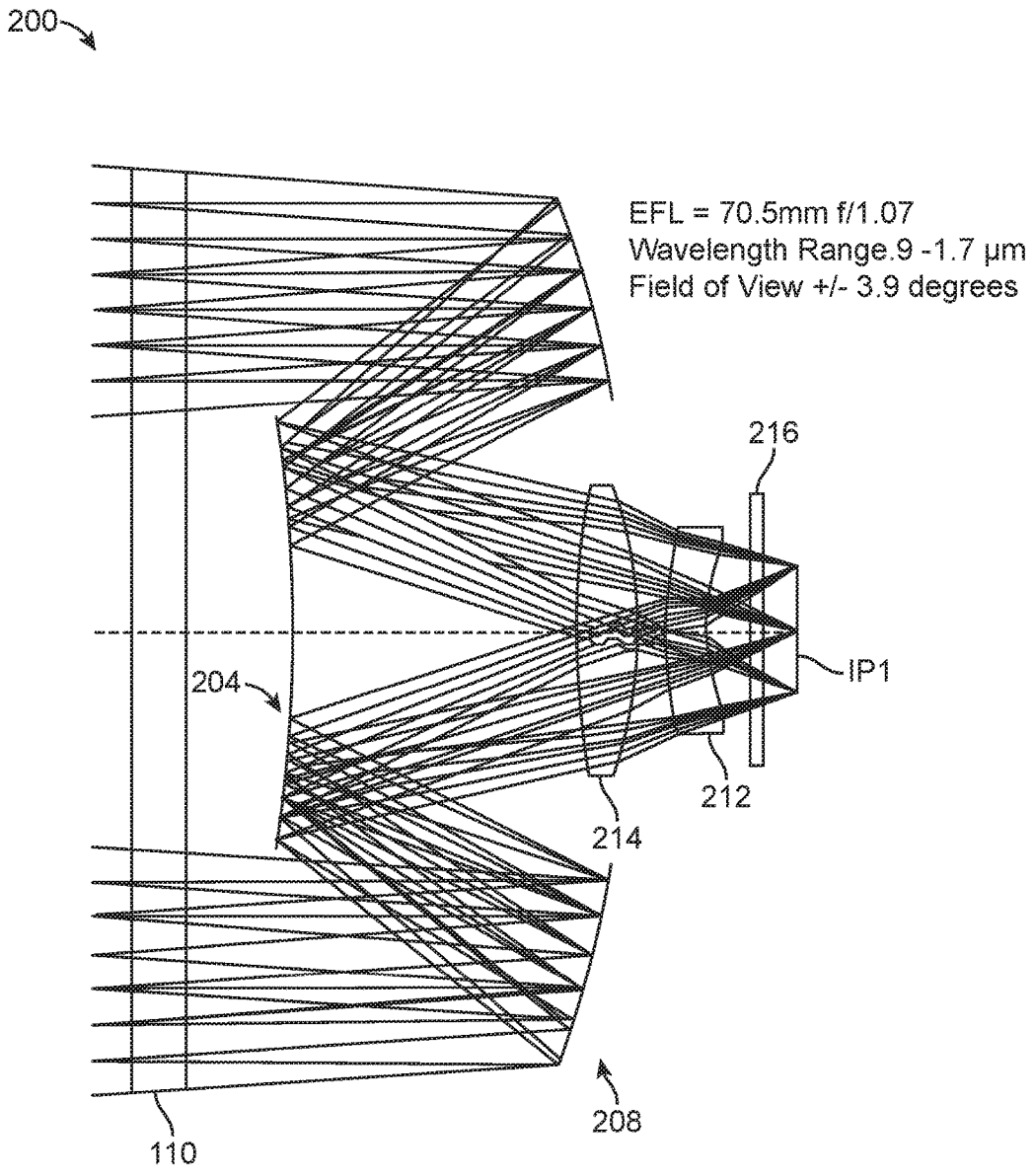
FIG. 5A is a close-up view of an example first catadioptric optical system of the multi-spectral weapon sight optical system of FIG. 4.

FIG. 5A is a close-up view the first catadioptric optical system 200 of the multi-spectral weapon sight optical system 350 of FIG. 4. The first catadioptric optical system 200 is configured to image SWIR radiation 150-1 and includes the aforementioned achromatic field corrector constituted by refractive lens element 214 in the form of a $CaF_2$ bi-convex lens and refractive lens element 212 in the form of a ZnSe meniscus lens. The primary partially reflecting mirror 208 is made of germanium and includes the aforementioned dichroic coating that substantially reflects SWIR radiation 150-1 and substantially transmits LWIR radiation 150-2. The first catadioptric optical system 200 has a first image plane IP1 wherein the first image 11 is formed (see FIG. 3A). The first image plane IP1 defines a first focus. In an example, a filter 216 (see FIG. 5A) is arranged adjacent first image plane IP1 to ensure that first image sensor detects only radiation 150-1 and no radiation outside of the first wavelength band. In an example, filter 216 is a sensor window.

The lens prescription data for the example first catadioptric optical system of FIG. 5A is set forth in Appendix A below.

Figure 5B:
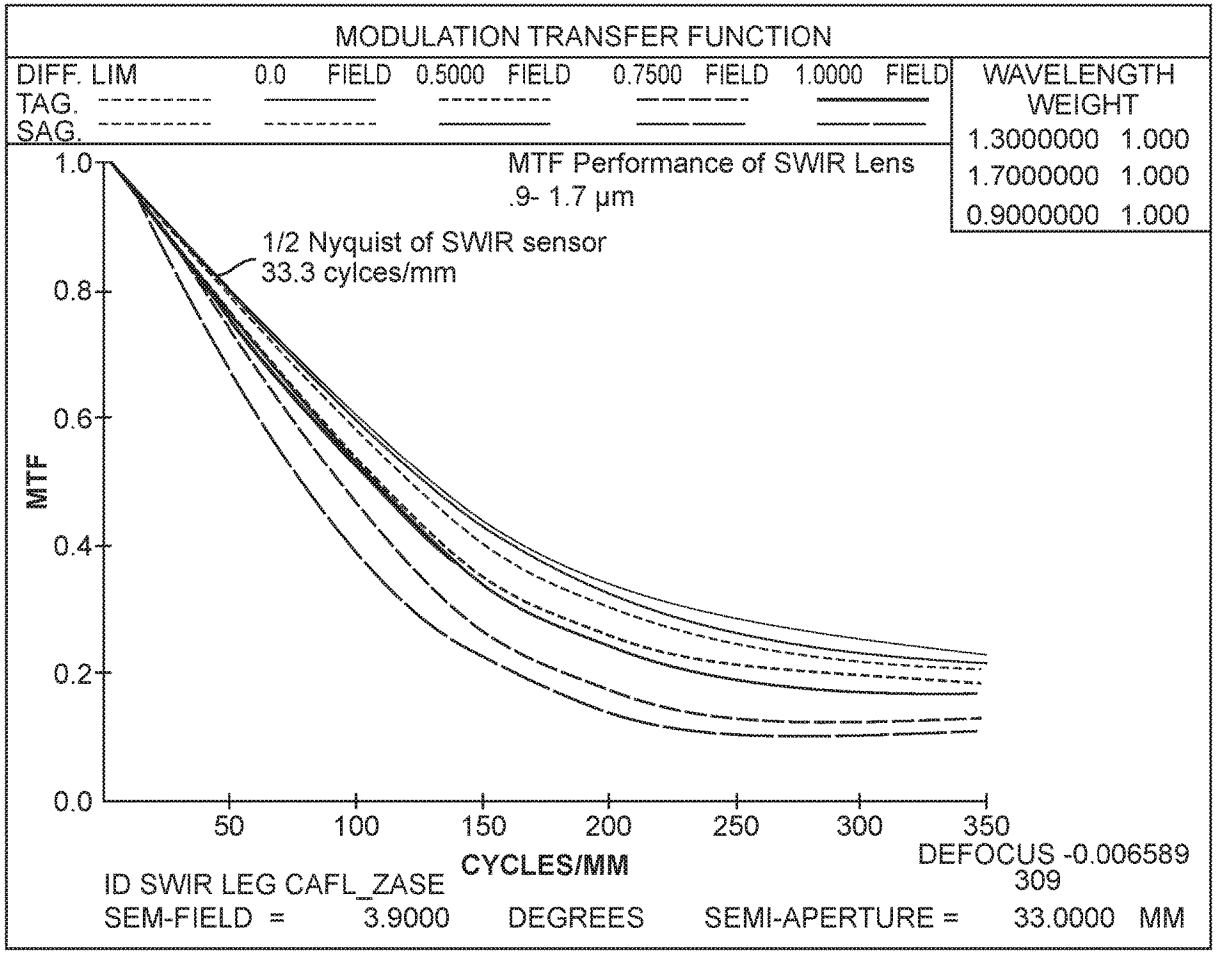
FIG. 5B is a modulation transfer function (MTF) plot of the first catadioptric optical system of FIG. 5A, which images over the SWIR wavelength band.

FIG. 5B is a modulation transfer function (MTF) plot of the first catadioptric optical system 200 of FIG. 5A that images over the SWIR wavelength band. The MTF plot includes data for 0.9 microns, 1.3 microns and 1.7 microns and for normalized field heights of 0 (on axis), 0.5, 0.75 and 1, and shows very good optical performance for the spatial frequencies of interest.

Figure 6A:
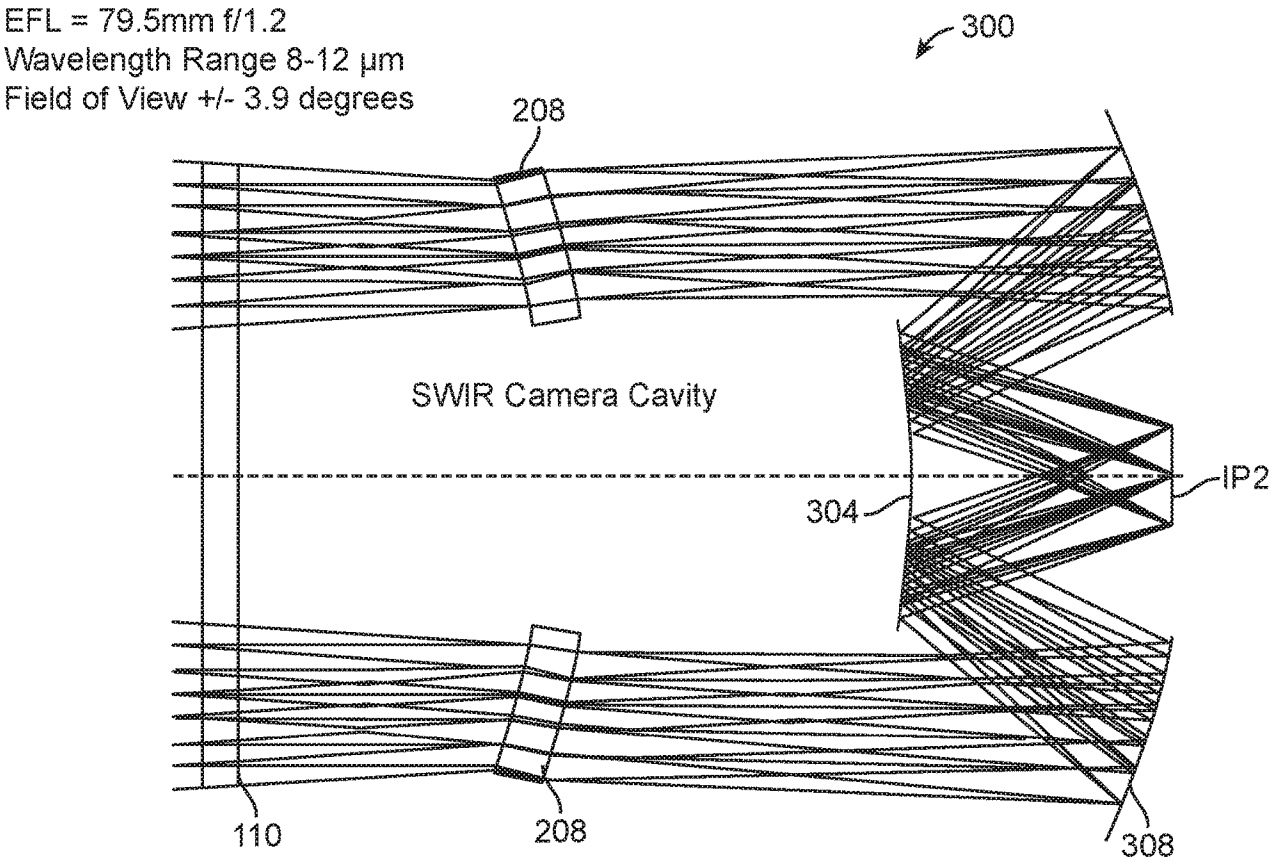
FIG. 6A is a close-up view an example second catadioptric optical system of the multi-spectral weapon sight optical system of FIG. 4.

FIG. 6A is a close-up view an example second catadioptric optical system 300 of the multi-spectral weapon sight optical system 250 of FIG. 4. The second catadioptric optical system 200 is configured to image LWIR radiation 150-2 and has no refractive lens elements between the convex secondary mirror 304 and second image sensor 320. The only refractive element is the germanium concave element 208 that serves a corrector.

The lens prescription data for the example second catadioptric optical system 300 of FIG. 6A is set forth in Appendix B below.

Figure 6B:
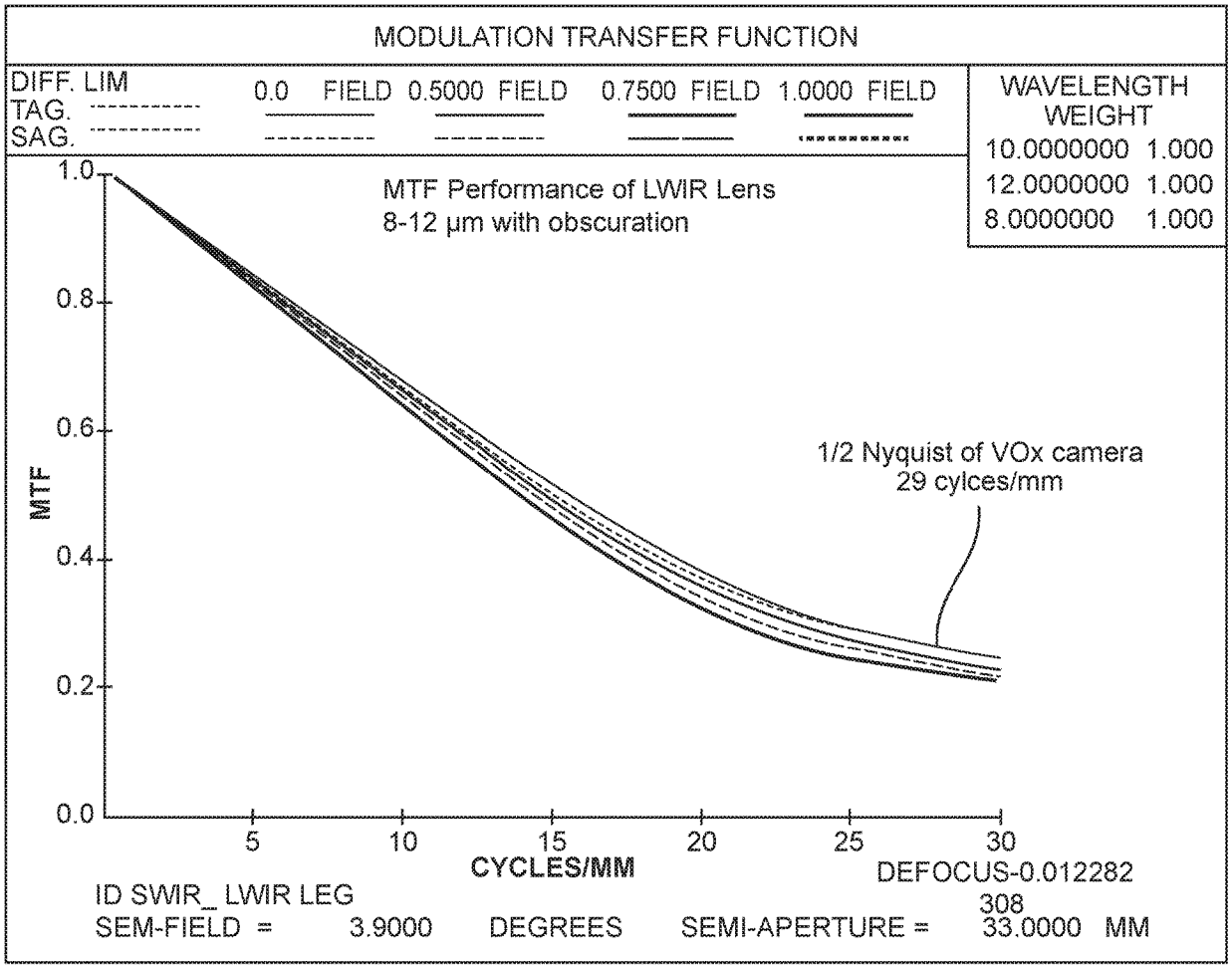
FIG. 6B is a modulation transfer function (MTF) plot of the second catadioptric optical system of FIG. 5A, which images over the LWIR wavelength band.

FIG. 6B is a modulation transfer function (MTF) plot of the second catadioptric optical system of FIG. 6A that images over the LWIR wavelength band. The MTF plot includes data for 0.9 microns, 1.3 microns and 1.7 microns and for normalized field heights of 0 (on axis), 0.5, 0.75 and 1, and shows very good optical performance for the spatial frequencies of interest.

Electronics System

Figure 7:
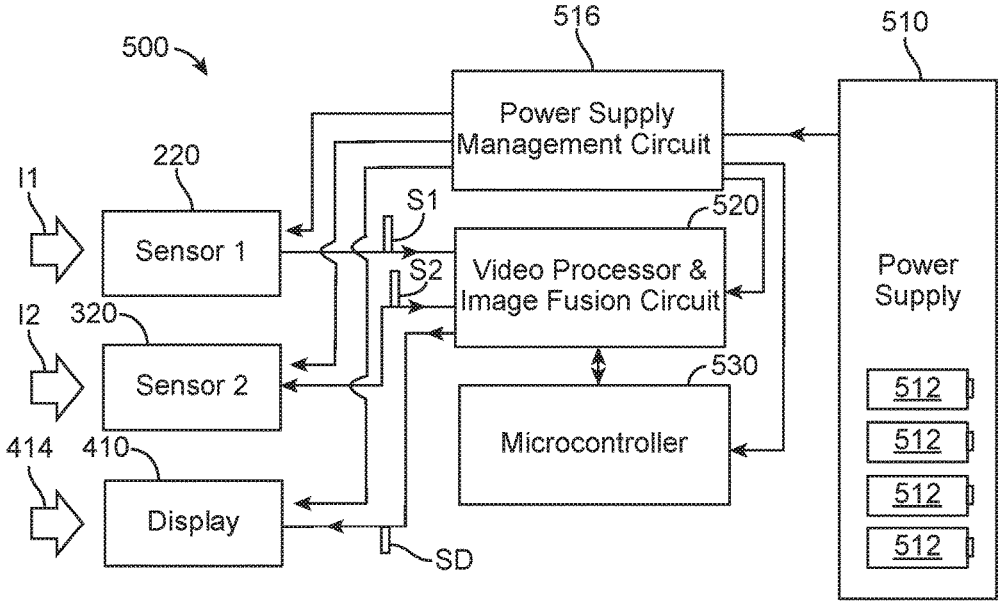
FIG. 7 is as schematic diagram of the electronic system of the multi-spectral weapon sight as disclosed herein.

FIG. 7 is a schematic diagram of an example configuration for electronics system 500, which is integrated into the multi-spectral weapon sight optical system 300 to form multi-spectral weapon sight 100. The electronics system 500 includes the first and second image sensors 220 and 230, and also includes the display 410. The electronics system 500 includes a local power supply 510 (e.g., including one or more batteries 512) that generates electrical power. The heavier lines in FIG. 7 represent the transmission of electrical power, while the lighter lines represent the transmission of electrical signals. In an example, batteries 512 can be AA batteries or DL123 batteries operably supported in a cassette-type battery holder. Thus, in an example, local power supply 510 is a battery power supply configured to be easily removed and installed.

The electronics system 500 also includes a power supply management circuit 516 electrically connected to local power supply 510 and configured to manage the power consumption and distribution in the electronics system.

The electronics system 500 also includes a video processor and image fusion circuit 520 and a microcontroller circuit 530 electrically connected to the power supply management circuit 516 and to each other. The video processor and image fusion circuit 520 is also electrically connected to first and second sensors 220 and 320 and to display 410, which are electrically connected to the power supply management circuit 516. The power supply management circuit 516 thus provides managed electrical power to the first and second image sensors 220 and 320 and to the display 410, as well as to the video processor and image fusion circuit 520 and the microcontroller 530.

With reference now to FIGS. 3A, 3C and 7, in the general operation of multi-spectral system 100, first and second radiation 150-1 and 150-2 from scene (radiation) 150 passes through the single aperture AP at input end 102 of housing 101 and to first catadioptric optical system 200. In an example, this includes the first and second radiation 150-1 and 150-2 passing through window 110. As noted above, primary partially reflecting primary mirror 208 is configured substantially reflect first radiation 150-1 having the wavelength band $\Delta\lambda_1$ while substantially transmitting the second radiation 150-2 of wavelength band $\Delta\lambda_2$. Thus, the first image 11 formed by the first catadioptric optical system 200 using first radiation 150-1 is received by first image sensor 220, which forms the aforementioned first digital image and the corresponding first digital image signal S1.

The second catadioptric optical system 300 receives the second radiation 150-2 that passes through the primary partially reflecting primary mirror 208 and forms the aforementioned second image on second image sensor 320, which converts the optical image into a second digital image and the corresponding second digital image signal S2.

In an example, the meniscus refractive elements 212 and 312 are axially movable to provide focus of the respective first and second images 11 and 12 on respective first and second image sensors 220 and 320. In an example, meniscus refractive elements 212 and 312 can be configured to move together to provide parfocal imaging capability. In an example, the second meniscus refractive element 312 is not employed and the single meniscus refractive element 212 is used to adjust focus for first image 11.

The first and second digital image signals S1 and S2 are sent to and received by the video processor and image fusion circuit 520, which processes the digital image signals to form the aforementioned fused image. In particular, the video processor and image fusion circuit, with the assistance of microcontroller 530, is configured to take the intensity value for a given pixel on first image sensor 220 and fuse it with the intensity value for the corresponding pixel on the second image sensor 320 to form the fused image. The image fusion process includes matching the pixels for the first and second digital images for the given scene, including performing any necessary scaling that arises due to the different sizes of the first and second image sensors 220 and 320. The fused image is embodied in the display signal SD, which is sent to display 410, which generates the (visible) display image 414.

APPENDIX A

Lens Prescription for SWIR Catadioptric optical system

SYSTEM SPECIFICATIONS

| | | | |
|---|---|---|---|
| OBJECT DISTANCE (TH0) | INFINITE | FOCAL LENGTH (FOCL) | 70.5007 |
| OBJECT HEIGHT (YPP0) | INFINITE | PARAXIAL FOCAL POINT | 2.6566 |
| MARG RAY HEIGHT (YMP1) | 33.0000 | IMAGE DISTANCE (BACK) | 2.6500 |
| MARG RAY ANGLE (UMP0) | 0.0000 | CELL LENGTH (TOTL) | 52.4675 |
| CHIEF RAY HEIGHT (YPP1) | −2.7152 | F/NUMBER (FNUM) | 1.0682 |
| CHIEF RAY ANGLE (UPP0) | 3.9000 | GAUSSIAN IMAGE HT (GIHT) | 4.8056 |
| ENTR PUPIL SEMI-APERTURE | 33.0000 | EXIT PUPIL SEMI-APERTURE | 23.6854 |
| ENTR PUPIL LOCATION | 39.8282 | EXIT PUPIL LOCATION | −47.9445 |
| WAVL (uM) 1.700000 1.300000 .9000000 | | | |
| WEIGHTS 1.000000 1.000000 1.000000 | | | |
| COLOR ORDER 2 1 3 | | | |
| UNITS | MM | | |
| APERTURE STOP SURFACE (APS) | 4 | SEMI-APERTURE | 33.47914 |
| REAL PUPIL OPTION | ON | | |
| WIDE-ANGLE PUPIL OPTION (WAP) | 1 | | |
| FOCAL MODE | ON | | |
| MAGNIFICATION | −7.04915E−11 | | |
| GLOBAL OPTION | ON | | |
| POLARIZATION AND COATINGS ARE IGNORED. | | | |

SURFACE DATA

| SURF | RADIUS | THICKNESS | MEDIUM | INDEX | V-NUMBER |
|---|---|---|---|---|---|
| 0 | INFINITE | INFINITE | AIR | | |
| 1 | INFINITE | 3.20575 | AIR | | |
| 2 | INFINITE | 4.00000 | ZNSE | 2.46546 | 28.32 UNUSUAL |
| 3 | INFINITE | 35.00000 | AIR | | |
| 4 | −92.67591 O | −26.50000 | AIR | <– | |
| 5 | −77.19994 O | 22.00000 | AIR | | |
| 6 | 63.75869 | 4.75000 | CAFL | 1.42721 | 99.53 UNUSUAL |
| 7 | −36.05070 | 2.01173 | AIR | | |
| 8 | 17.35114 O | 3.50000 | ZNSE | 2.46546 | 28.32 UNUSUAL |
| 9 | 13.29038 O | 3.50000 | AIR | | |
| 10 | INFINITE | 1.00000 | SAPPHIRE | 1.75048 | 52.78 UNUSUAL |
| 11 | INFINITE | 0.00000 | AIR | | |
| 12 | INFINITE | 0.00000 | AIR | | |
| 13 | INFINITE | 2.65000 | AIR | | |
| IMG | INFINITE | | | | |

KEY TO SYMBOLS

| | |
|---|---|
| A SURFACE HAS TILTS AND DECENTERS | B TAG ON SURFACE |
| G SURFACE IS IN GLOBAL COORDINATES | L SURFACE IS IN LOCAL COORDINATES |
| O SPECIAL SURFACE TYPE | P ITEM IS SUBJECT TO PICKUP |
| S ITEM IS SUBJECT TO SOLVE | M SURFACE HAS MELT INDEX DATA |
| T ITEM IS TARGET OF A PICKUP | |

SPECIAL SURFACE DATA

SURFACE NO. 4 - CONIC + POWER-SERIES ASPHERE

G 3 −5.098141E−07(R4) G 6 1.380131E−10(R6) G 1 −2.419250E−14(R**8)

G 1 1.817899E−18(R**10)

APPENDIX A-continued

Lens Prescription for SWIR Catadioptric optical system

| | | | |
|---|---|---|---|
| CONIC CONSTANT (CC) | −4.929482 | | |
| SEMI-MAJOR AXIS (b) | 23.584768 | SEMI-MINOR AXIS (a) | −46.751897 |
| SURFACE NO. 5 - CONIC + POWER-SERIES ASPHERE | | | |
| G 3 5.978553E−07(R**4) | | G 6 1.603546E−10(R**6) | G 1 −1.171060E−12(R**8) |
| G 1 3.022898E−18(R**10) | | | |
| CONIC CONSTANT (CC) | −16.673324 | | |
| SEMI-MAJOR AXIS (b) | 4.925562 | SEMI-MINOR AXIS (a) | −19.500080 |
| SURFACE NO. 8 - CONIC + POWER-SERIES ASPHERE | | | |
| G 3 −0.000154(R**4) | | G 6 −1.355246E−06(R**6) | G 1 3.206502E−09(R**8) |
| G 1 −6.305832E−11(R**10) | | | |
| CONIC CONSTANT (CC) | 1.724480 | | |
| SEMI-MAJOR AXIS (b) | 6.368605 | SEMI-MINOR AXIS (a) | 10.512019 |
| SURFACE NO. 9 - CONIC + POWER-SERIES ASPHERE | | | |
| G 3 −0.000256(R**4) | | G 6 −3.553759E−06(R**6) | G 1 3.027815E−08(R**8) |
| G 1 −4.444199E−10(R**10) | | | |
| CONIC CONSTANT (CC) | 1.33312 | | |
| SEMI-MAJOR AXIS (b) | 5.69639 | | |
| SEMI-MINOR AXIS (a) | 8.7 | | |

APPENDIX B

Lens Prescription for LWIR Catadioptric optical system

SYSTEM SPECIFICATIONS

| | | | |
|---|---|---|---|
| OBJECT DISTANCE (TH0) | INFINITE | FOCAL LENGTH (FOCL) | 79.4994 |
| OBJECT HEIGHT (YPP0) | INFINITE | PARAXIAL FOCAL POINT | 29.4349 |
| MARG RAY HEIGHT (YMP1) | 33.0000 | IMAGE DISTANCE (BACK) | 29.4226 |
| MARG RAY ANGLE (UMP0) | 0.0000 | CELL LENGTH (TOTL) | 83.7058 |
| CHIEF RAY HEIGHT (YPP1) | −2.7179 | F/NUMBER (FNUM) | 1.2045 |
| CHIEF RAY ANGLE (UPP0) | 3.9000 | GAUSSIAN IMAGE HT (GIHT) | 5.4190 |
| ENTR PUPIL SEMI-APERTURE | 33.0000 | EXIT PUPIL SEMI-APERTURE | 40.0710 |
| ENTR PUPIL LOCATION | 39.8679 | EXIT PUPIL LOCATION | −67.0991 |
| WAVL (uM) 12.00000 10.00000 8.000000 | | | |
| WEIGHTS 1.000000 1.000000 1.000000 | | | |
| COLOR ORDER 2 1 3 | | | |
| UNITS | MM | | |
| APERTURE STOP SURFACE (APS) | 4 | SEMI-APERTURE | 33.40070 |
| REAL PUPIL OPTION | ON | | |
| FOCAL MODE | ON | | |
| MAGNIFICATION | −7.94892E−11 | | |
| GLOBAL OPTION | ON | | |
| POLARIZATION AND COATINGS ARE IGNORED. | | | |

SURFACE DATA

| SURF | RADIUS | THICKNESS | MEDIUM | INDEX | V-NUMBER |
|---|---|---|---|---|---|
| 0 | INFINITE | INFINITE | AIR | | |
| 1 | INFINITE | 3.20575 | AIR | | |
| 2 | INFINITE | 4.00000 | ZNSE | 2.40651 | 57.83 UNUSUAL |
| 3 | INFINITE | 35.00000 | AIR | | |
| 4 | −92.67591 O | 5.50000 | GE | 4.00243 | 833.78 UNUSUAL |
| 5 | −94.83915 O | 67.00000 | AIR | | |
| 6 | −101.83845 O | −31.00000 | AIR | <− | |
| 7 | −95.88560 O | 29.42260 | AIR | | |
| IMG | INFINITE | | | | |

KEY TO SYMBOLS

| | |
|---|---|
| A SURFACE HAS TILTS AND DECENTERS | B TAG ON SURFACE |
| G SURFACE IS IN GLOBAL COORDINATES | L SURFACE IS IN LOCAL COORDINATES |
| O SPECIAL SURFACE TYPE | P ITEM IS SUBJECT TO PICKUP |
| S ITEM IS SUBJECT TO SOLVE | M SURFACE HAS MELT INDEX DATA |
| T ITEM IS TARGET OF A PICKUP | |

SPECIAL SURFACE DATA

| | | | |
|---|---|---|---|
| SURFACE NO. 4 - CONIC + POWER-SERIES ASPHERE | | | |
| G 3 −5.098124E−07(R**4) | | G 6 1.380131E−10(R**6) | G 1 −2.419250E−14(R**8) |
| G 1 1.817899E−18(R**10) | | | |
| CONIC CONSTANT (CC) | −4.929482 | | |
| SEMI-MAJOR AXIS (b) | 23.584765 | SEMI-MINOR AXIS (a) | −46.751894 |
| SURFACE NO. 5 - CONIC + POWER-SERIES ASPHERE | | | |

APPENDIX B-continued

| Lens Prescription for LWIR Catadioptric optical system | | | |
|---|---|---|---|
| G 3 1.994137E−07(R**4) | | G 6 1.667626E−11(R**6) | G 1 4.090298E−15(R**8) |
| G 1 −5.075663E−19(R**10) | | | |
| CONIC CONSTANT (CC) | −0.932994 | | |
| SEMI-MAJOR AXIS (b) | −1415.387768 | SEMI-MINOR AXIS (a) | 366.379815 |
| SURFACE NO. 6 - CONIC + POWER-SERIES ASPHERE | | | |
| G 3 −9.452042E−07(R**4) | | G 6 1.762952E−10(R**6) | G 1 −4.023529E−14(R**8) |
| G 1 4.150549E−18(R**10) | | | |
| CONIC CONSTANT (CC) | −6.845815 | | |
| SEMI-MAJOR AXIS (b) | 17.420745 | SEMI-MINOR AXIS (a) | 42.120086 |
| SURFACE NO. 7 - CONIC + POWER-SERIES ASPHERE | | | |
| G 3 −9.418938E−06(R**4) | | G 6 1.803210E−08(R**6) | G 1 −2.771670E−11(R**8) |
| G 1 2.000517E−14(R**10) | | | |
| CONIC CONSTANT (CC) | −57.022410 | | |
| SEMI-MAJOR AXIS (b) | 1.711558 | SEMI-MINOR AXIS (a) | −12.810689 |

It will be apparent to those skilled in the art that various modifications to the preferred embodiments of the disclosure as described herein can be made without departing from the spirit or scope of the disclosure as defined in the appended claims. Thus, the disclosure covers the modifications and variations provided they come within the scope of the appended claims and the equivalents thereto.

What is claimed is:

1. A multi-spectral weapon sight optical system, comprising:

a first catadioptric optical system having a first optical axis and comprising a first primary concave mirror that substantially reflects first radiation having a first wavelength band and that substantially transmits second radiation having a second wavelength band different from the first wavelength band, the first catadioptric optical system forming a first image at a first image plane on the first optical axis using the first radiation; and a second catadioptric optical system having a second optical axis and arranged optically downstream from and in line with the first catadioptric optical system, with the second optical axis being coaxial with the first optical axis, the second catadioptric optical system comprising a second primary concave mirror that receives and reflects the transmitted second radiation and that forms from the transmitted second radiation a second image at a second image plane on the optical axis using the second radiation.

2. The multi-spectral weapon sight optical system according to claim 1, wherein the first catadioptric optical system and the second catadioptric optical system respectively include first and second focuses and respectively include first and second axially movable lenses configured to adjust the first and second focuses.

3. The multi-spectral weapon sight optical system according to claim 2, wherein the first and second axially movable lenses are movable such that the first and second focuses are parfocal.

4. The multi-spectral weapon sight optical system according to claim 1, wherein the first wavelength band includes short-infrared wavelengths and wherein the second wavelength band includes long infrared wavelengths.

5. The multi-spectral weapon sight optical system according to claim 4, wherein the first wavelength band also includes visible wavelengths.

6. The multi-spectral weapon sight optical system according to claim 4, wherein the first wavelength band is in the range from 900 nm to 1,700 nm and the second wavelength band is in the range from 8,000 nm to 12,000 nm.

7. The multi-spectral weapon sight optical system according to claim 5, wherein the first wavelength band is in the range from 600 nm to 1,600 nm and the second wavelength band is in the range from 8,000 nm to 14,000 nm.

8. The multi-spectral weapon sight optical system according to claim 1, wherein the first primary concave mirror of the first catadioptric optical system includes a dichroic optical coating that substantially reflects the first radiation and substantially transmits the second radiation.

9. The multi-spectral weapon sight optical system according to claim 8, wherein the first concave mirror is made of germanium.

10. The multi-spectral weapon sight optical system according to claim 8, wherein the first concave mirror is aspheric.

11. The multi-spectral weapon sight optical system according to claim 1, wherein the system has substantially 1× magnification.

12. A multi-spectral weapon sight, comprising:

the multi-spectral weapon sight optical system according to claim 1;

a first image sensor arranged at the first image plane and configured to generate a first digital image;

a second first image sensor arranged at the first image plane and configured to generate a second digital image;

an electronics system configured to receive and process the first and second digital images to form a fused digital display image; and a display electrically connected to the electronics system and configured to receive the fused digital display image and form a visible display image.

13. A multi-spectral weapon sight system for use by a user, comprising:

the multi-spectral weapon sight according to claim 12:

a display optical system operably arranged adjacent the display; and a day sight operably arranged adjacent the display optical system so that the user can view the visible display image via the display optical system.

14. A multi-spectral weapon sight optical system for forming first and second images from first and second radiation having different respective first and second wavelength bands, comprising:

first and second catadioptric optical systems arranged in line along a common axis and that share a single aperture;

wherein the first catadioptric optical system comprises a first primary concave mirror configured to reflect the first radiation to form a first image using the first radiation while transmitting the second radiation to the second catadioptric optical system, and wherein the first primary concave mirror serves as a corrector for the second catadioptric optical system;

wherein the second catadioptric optical system comprises a second primary concave mirror is configured to receive and reflect the second radiation transmitted by the first catadioptric optical system and form a second image using the transmitted second radiation; and wherein the first and second images are each formed on the common axis.

15. The multi-spectral weapon sight optical system according to claim 14, wherein the first and second catadioptric optical systems are each parfocal.

16. The multi-spectral weapon sight optical system according to claim 14, wherein the first wavelength band includes short-infrared wavelengths and wherein the second wavelength band includes long infrared wavelengths.

17. The multi-spectral weapon sight optical system according to claim 15, wherein the first wavelength band include visible wavelengths.

18. The multi-spectral weapon sight optical system according to claim 16, wherein the first wavelength band is in the range from 900 nm to 1,700 nm and the second wavelength band is in the range from 8,000 nm to 12,000 nm.

19. The multi-spectral weapon sight optical system according to claim 14, wherein the first primary concave mirror includes a dichroic optical coating that substantially reflects the first radiation and substantially transmits the second radiation.

20. A multi-spectral weapon sight, comprising:

the multi-spectral weapon sight optical system according to claim 14;

a first image sensor arranged to receive the first image and that in response generates a first digital image;

a second first image sensor arranged to receive the second image and that in response generates a first digital image;

an electronics system configured to receive and process the first and second digital images to form a fused digital display image; and a display electrically connected to the electronics system and configured to receive the fused digital display image and form a visible display image.

21. The multi-spectral weapon sight according to claim 20, including a housing configured to be clipped on and off of a rail mount of a weapon.

22. A multi-spectral weapon sight system for use by a user, comprising:

the multi-spectral weapon sight according to claim 20;

a display optical system operably arranged adjacent the display; and a day sight operably arranged adjacent the display optical system so that the user can view the visible display image via the display optical system.

* * * * *